US007581701B2

(12) United States Patent
Logosz et al.

(10) Patent No.: US 7,581,701 B2
(45) Date of Patent: Sep. 1, 2009

(54) KITE CONTROL DEVICE

(76) Inventors: Tony Logosz, 1413 A St., Hood River, OR (US) 97031; John Doyle, 9 Oakleaf La., White Salmon, WA (US) 98672; Alex Peterson, 1307 Cascade Ave., Hood River, OR (US) 97031

( * ) Notice: Subject to any disclaimer, the term of this patent is extended or adjusted under 35 U.S.C. 154(b) by 305 days.

(21) Appl. No.: 11/267,947

(22) Filed: Nov. 3, 2005

(65) Prior Publication Data

US 2006/0226294 A1 Oct. 12, 2006

Related U.S. Application Data

(63) Continuation-in-part of application No. 11/100,911, filed on Apr. 6, 2005.

(51) Int. Cl.
*A63H 27/08* (2006.01)

(52) U.S. Cl. ..... 244/155 A

(58) Field of Classification Search ..... 244/153 R, 244/155 R, 153 A

See application file for complete search history.

(56) References Cited

U.S. PATENT DOCUMENTS

| | | | | |
|---|---|---|---|---|
| 6,260,803 | B1 * | 7/2001 | Hunts | 244/155 R |
| 6,273,369 | B1 * | 8/2001 | Nishimura et al. | 244/155 A |
| 6,513,759 | B2 * | 2/2003 | Starbuck | 244/155 A |
| 6,581,879 | B2 * | 6/2003 | Bellacera | 244/155 A |
| 6,691,954 | B1 * | 2/2004 | Harrington et al. | 244/155 A |
| 6,745,713 | B2 * | 6/2004 | Starbuck | 114/39.16 |
| 6,830,220 | B2 * | 12/2004 | Runyan | 244/155 A |
| 6,869,047 | B2 * | 3/2005 | Pouchkarev | 244/155 A |
| 6,877,697 | B2 * | 4/2005 | Bellacera | 244/155 A |
| 6,988,694 | B2 * | 1/2006 | Barrs et al. | 244/155 A |
| 7,036,771 | B1 * | 5/2006 | Pouchkarev | 244/155 A |
| 7,182,294 | B2 * | 2/2007 | Blackman | 244/155 A |
| 2004/0182968 | A1 * | 9/2004 | Gentry | 244/155 A |
| 2004/0195459 | A1 * | 10/2004 | Pouchkarev | 244/153 R |
| 2005/0040291 | A1 * | 2/2005 | Hansel | 244/155 A |
| 2006/0243862 | A1 * | 11/2006 | Roger | 244/155 A |
| 2007/0120016 | A1 * | 5/2007 | Eberle et al. | 244/153 R |
| 2008/0067291 | A1 * | 3/2008 | Logosz et al. | 244/155 A |

FOREIGN PATENT DOCUMENTS

| | | | |
|---|---|---|---|
| DE | 10162859 | C1 * | 6/2003 |
| WO | WO 2005058695 | A1 * | 6/2005 |

* cited by examiner

*Primary Examiner*—Michael R Mansen
*Assistant Examiner*—Joseph W Sanderson

(57) ABSTRACT

A control device for use with an aerodynamic wing including a bar having a fixed trim adjustment located between the bar and the user. The invention also includes a stopper that permits the user to quickly adjust the range of available dynamic trim. Preferably, the stopper does not lock until it engages the control bar, allowing the user to slide it quickly and easily to the desired location. The control systems of the invention provide a safety depower function when the end of the fixed trim is secured to a safety line.

14 Claims, 10 Drawing Sheets

KITE CONTROL DEVICE

CROSS-REFERENCE TO RELATED APPLICATIONS

This application is a continuation-in-part of U.S. patent application Ser. No. 11/100,911, filed Apr. 6, 2005.

FIELD OF THE PRESENT INVENTION

The present invention relates generally to devices for controlling inflatable power or traction kites. More particularly, the invention relates to a bar for controlling a kite having enhanced depower capabilities and improved ease of use.

BACKGROUND OF THE INVENTION

Considerable effort is being expended to develop wings capable of generating tractive force for the purposes of powering a user on a variety of vehicles that are tethered solely by flexible lines. Such wings can generally be considered kites. The development of kites capable of generating significant force has made possible numerous recreational pursuits. For example, kite surfing or kite boarding refers to a sport involving the use of a wind powered wing to pull the participant on a vehicle across a body of water. Similar sports involving the use of appropriately configured vehicles to traverse sand, earth, snow and ice are also being pursued. One of skill in the art will also recognize that wind powered wings can be used in any number of other applications, whether recreational or practical. With the development of these applications has come an increasing demand for kites having improved characteristics.

One type of kite that has achieved popularity is a leading edge inflatable ("LEI") kite, typically comprising a semi-rigid framework of inflatable struts or spars that support a canopy to form the profile of the wing. This basic design is disclosed in U.S. Pat. No. 4,708,078 to Legaignoux, et al. The development of the LEI kite is generally credited with spurring the development of modern kite surfing due to its ability to be relaunched from the water's surface.

Most LEI kites currently employ four or five lines to control the kite. Two steering lines are attached at opposing ends of the kite at the trailing edge and at opposing ends of a control bar. Two front lines are attached at opposing ends of the kite at the leading edge and are secured to the middle of the control bar or to the user. The kite is steered by pivoting the control bar about a central axis to transmit force along the steering lines to the trailing edge of the kite. Further, by varying the relative length of the steering lines with respect to the front lines, the angle of attack of the kite can be adjusted, or "trimmed." This has the effect of providing control over the amount of lifting force developed by the kite. Most kite control systems have a "fixed" adjustment mechanism for setting the trim of the kite by using a cleat, adjustable strap, or the like, which is positioned above the bar, meaning between the bar and the kite. Most control systems also provide "variable" dynamic trim adjustment by providing an attachment for the front lines to the user. Thus, the trim of the kite is constantly adjusted by moving the control bar in and out from the user's body. Kites employing a five line system have an additional control line secured to the leading edge between the kite tips. The fifth line helps maintain the shape of the kite and can allow the user to control a greater range of kite trim than possible using a four line system that is attached only to the tips.

As can be appreciated, LEI kites generally have a shape imparted by the inflated leading edge, the tension applied to the control lines and the aerodynamic forces experienced by the kite due to the movement of air across its surfaces. Although the inflatable leading edge is capable of contributing significant structure to the kite, there are practical limits related to the inflation pressure, the diameter of the leading edge and the strength of the materials. Accordingly, most LEI kites exhibit a pronounced arc shape caused by the balance between the force exerted by the control lines, which tend to bring the opposing edges together, and the structure imparted by the leading edge, which provides the effective lifting surface.

One drawback that has been observed with regard to the noted LEI kites is that the arc shape positions a substantial portion of the kite's surface in an orientation that is not perpendicular to the desired direction of the lifting force. Accordingly, attempts have been made to create a LEI kite that exhibits a flatter arc in flight, so that a greater proportion of the kite's surface is perpendicular to the lifting force, thus providing a more efficient airfoil. For example, U.S. patent application Ser. No. 11/067,842, which is hereby incorporated by reference in its entirety, discloses an LEI kite that has a flattened shape imparted by a bridle arrangement that distributes some of the control forces along the leading edge rather than at the tips. Kites having these general characteristics are known in the art as "bow" kites.

Bow kites offer certain advantages over conventional LEI kites. As noted above, the flattened arc profile improves the proportion of the kite's surface that generates lift in the desired direction. A further advantage is that bow kites can be designed to exhibit a wider range of trim than conventional LEI kites. To exploit the enhanced trim characteristics, bow kites typically require a relatively complex control bar having a pulley arrangement at either end for transmitting the steering forces to the kite. The 2:1 purchase ratio of these pulleys creates twice the relative change in length between the front lines and steering lines for a given amount of bar movement compared to a conventional control bar. As a result, the user has greater control over the lifting power developed by the kite.

The enhanced control corresponds to improved safety, as the user has greater ability to depower the kite, either when a mistake has been made or when the wind increases in strength. Another safety provision associated with bow kites is that the user's safety line can be attached to the same attachment point used to secure the front lines to the user, such as the chicken loop. This safety system allows the user to simply drop the bar while unhooked, and the kite will completely depower while the user is still attached via the safety line. Since they are capable of nearly complete depowering while in flight, bow kites offer obvious improvements in safety. The noted systems also have performance advantages in that the user can quickly optimize the power of the kite when desired, such as when jumping, without being overpowered at other times.

Despite the benefits of bow kites, the control systems suffer from a number of deficiencies. For example, to accommodate pulley travel, the steering lines are typically routed through the pulley and attached to the front lines at a point distal to the user. In turn, the fixed trim adjustment is conventionally positioned adjacent this point of attachment. As a result, many users cannot easily reach a fixed trim adjustment in this location. One attempt to overcome this problem is exhibited by the Cabrinha Crossbow Control System. This control bar employs extenders to help the user reach the fixed trim adjustment. However, this system adds to the already complex bar and can be difficult to operate given the increased play inherent in extending the control surfaces.

As can be appreciated, the location of the fixed trim adjustment is a problem that confronts more conventional control systems as well. To provide a variable sheeting function, an extension of the front lines is routed through the control bar before attachment to the user. This allows the user to sheet the bar in and out to dynamically vary the relative length of the front lines as compared to the steering lines, and thus trim the kite. However, the fixed trim adjustment is conventionally positioned on the front lines at a point beyond the sheeting range of the control system. Accordingly, the greater the ability to sheet the kite, the further the fixed adjustment system must be positioned away from the user.

Another drawback associated with bow kites is that increased trim range makes it relatively easy to inadvertently depower the kite more than desired. While this is not primarily a safety issue, it can negatively effect the use of the kite. For example, if the user inadvertently depowers the kite too much while riding, the loss of force can cause the user to stop planing which is obviously undesirable. Likewise, too much depower in the middle of a jump can lead to a loss of lift and an undesirably abrupt descent. These effects are exacerbated when the user is using only one hand. Further, it is essentially impossible to ride without hands using a conventional control system as the kite immediately depowers when the control bar is released.

Yet another drawback associated with bow kites and their conventional control systems is that the user must continually sheet in on the bar to maintain power in the kite. This can be tiring and reduce the amount of time the user is able to fly the kite.

Still another drawback relates to safety systems. For example, in the noted Crossbow Control System, an Override™ system includes a releasable stopper ball secured to the front lines. In normal use, the stopper ball keeps the control bar from being sheeted out beyond the normal range of trim. However, by pushing the control bar against the stopper ball, it can be dislodged and the control bar can be sheeted out to the maximum degree, completely depowering the kite. Unfortunately, this system has certain weaknesses. First, after the stopper ball is dislodged, it must be reattached at the desired position, which could be challenging depending upon the circumstances. Second, the system relies on a friction fit to retain the stopper ball in position and is accordingly susceptible to wear and variability in performance, for example, if it gets fouled with sand. Additionally, there is the risk of the system being inadvertently activated if the user drops the bar or attempts to ride without hands.

Accordingly, it is an object of the present invention to provide a control system for a kite that offers improved usability and performance.

It is also an object of the present invention to provide a control system for a kite that provides easy access to the fixed trim adjustment mechanism.

It is another object of the present invention to provide a control system for a kite with a safety system that fully depowers the kite.

It is yet another object of the present invention to provide a control system for a kite to easily limit the range of sheeting available while preserving the operation of the safety system.

It is also an object of the present invention to provide a method for controlling a kite that offers improved usability and performance.

Another object of the invention is to provide a method and system adapted to improve the control of a bow kite.

A further object of the invention is to provide a method and system for adjusting the fixed trim of a kite at a location proximal to the user from the control bar.

Yet another object of the invention is to provide a method and system for controlling a kite that provides improved adjustment of the dynamic sheeting range.

SUMMARY OF THE INVENTION

In accordance with the above objects and those that will be mentioned and will become apparent below, the present invention is a system for controlling a kite including a control device comprising a bar with opposing ends adapted to transmit steering forces to the wing and a chicken loop line adapted to transmit tractive forces to a user, wherein the line is routed through an aperture on the bar and secured at a releasable attachment positioned between the bar and the user.

Preferably, the chicken loop line is secured to a chicken loop and the chicken loop line travels through an aperture on the bar, through a pulley above the bar, through an aperture on the bar before being secured by the releasable attachment.

In one embodiment of the invention, the aerodynamic wing is controlled by two steering lines and two front lines, the steering lines are controlled by the opposing ends of the bar and the front lines transmit force to the chicken loop line.

In the noted embodiment, the relative length of the front lines with respect to the steering lines is preferably adjustable by drawing a varying amount of chicken loop line through the releasable attachment and securing the chicken loop line in the releasable attachment.

In one embodiment of the invention, the releasable attachment is secured to the chicken loop line below the bar. In another embodiment, the releasable attachment is secured to the chicken loop. Preferably, the releasable attachment is a cleat.

In accordance with one aspect of the invention, the system includes a fixed stopper releasably secured to the chicken loop line between the bar and the pulley. In another aspect, the system includes a quick adjust stopper positioned between the bar and the pulley, wherein the quick adjust stopper includes two lumens adapted to receive the chicken loop line and wherein the quick adjust stopper is configured to cooperate with the bar to increase friction with the chicken loop line when the bar is adjacent the stopper. In a presently preferred embodiment, the quick adjust stopper further includes a wedge portion and the aperture on the bar has a tapered opening, and wherein engaging the wedge portion of the quick adjust stopper in the aperture creates sufficient friction with the chicken loop line to restrict movement of the quick adjust stopper.

The invention is also suitable for controlling five line kites, including embodiments where the fifth line is attached to the chicken loop line between the chicken loop and the pulley or where the control device further comprises a cleat secured to the chicken loop for adjusting a fifth line.

In another embodiment, the invention can be configured to depower four line kites, wherein one of the front lines is secured to the chicken loop line between the bar and the pulley.

In accordance with the invention, the chicken loop line has a distal end adjacent the releasable attachment and applying tension to the distal end preferably releases the chicken loop line from the releasable attachment, allowing the chicken loop line to travel through the pulley and through the aperture, decreasing distance between the bar and the pulley.

The invention also includes a method for controlling an aerodynamic wing with two steering lines and two front lines, comprising the steps of providing a control device including a bar with opposing ends connected to the steering lines, a chicken loop line adapted to transmit tractive forces from the front lines to a user, a releasable attachment positioned between the bar and the user, and a chicken loop secured to a first end of the chicken loop line, wherein the chicken loop line is routed from the chicken loop, through an aperture on the bar, through a pulley above the bar, through an aperture on the bar and is then secured by the releasable attachment, and trimming the aerodynamic wing by pulling a desired amount of chicken loop line through the releasable attachment and securing the chicken loop line to the releasable attachment. Preferably, the method further comprises the step of depowering the aerodynamic wing by applying tension to a second end of the chicken loop line secured by the releasable attachment to release the chicken loop line and allow the chicken loop line to travel through the pulley and the aperture to decrease distance between the bar and the pulley.

Preferably, movement of the bar along the chicken loop line dynamically sheets the aerodynamic wing. In such embodiments, the method of the invention preferably further comprises the step of adjusting the range of movement of the bar corresponding to the dynamic sheeting by positioning a stopper on the chicken loop line between the bar and the pulley. More preferably, the stopper is configured to cooperate with the bar to increase friction with the chicken loop line when the bar is adjacent the stopper.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Figure 1:
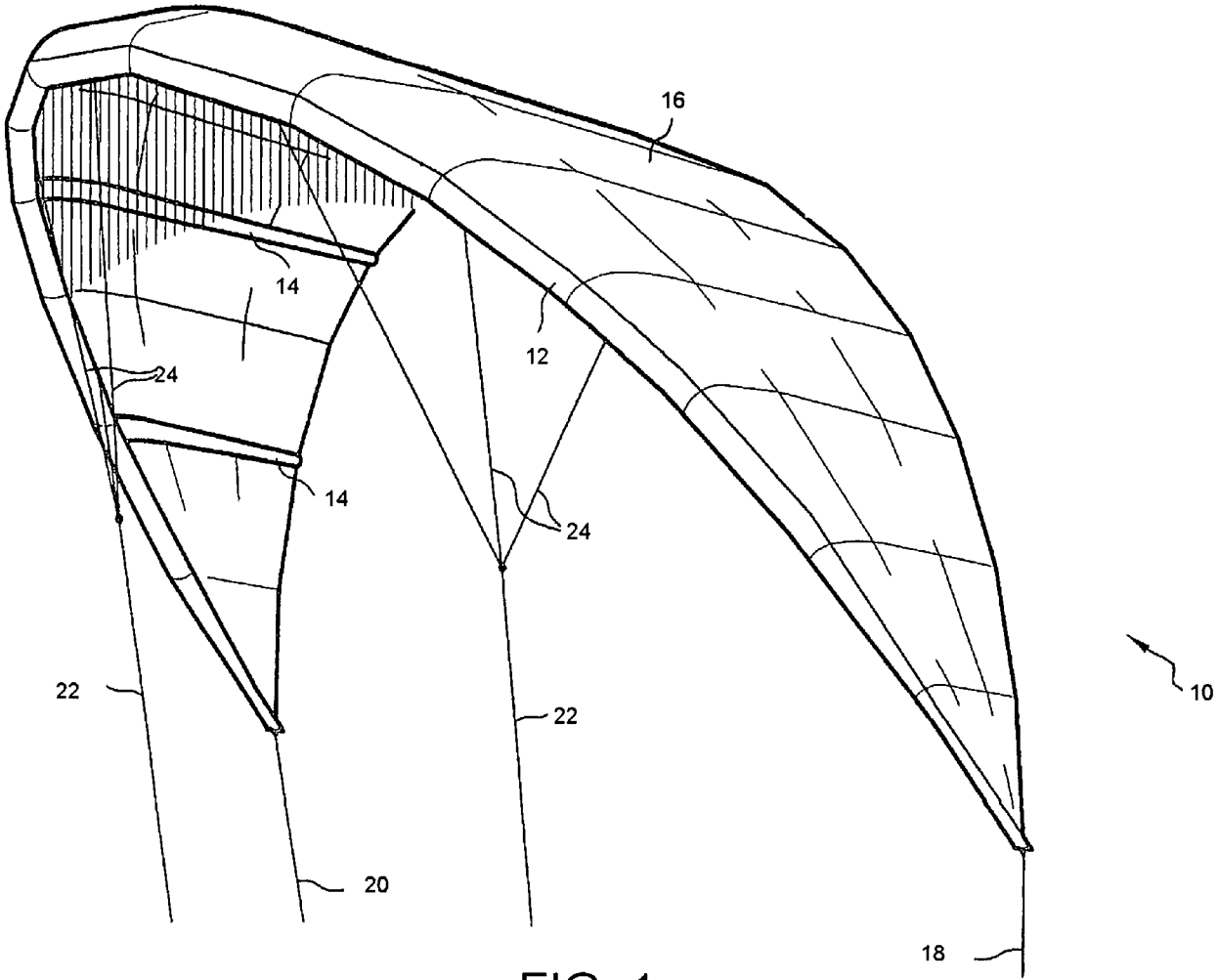
FIG. 1 is a perspective view of a bow kite, suitable for use with a control system embodying features of the invention.

Before describing the present invention in detail, it is to be understood that this invention is not limited to particularly exemplified materials, methods or structures as such may, of course, vary. Thus, although a number of materials and methods similar or equivalent to those described herein can be used in the practice of the present invention, the preferred materials and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise.

As used herein, the term "cleat" is meant to mean and include any readily releasable attachment mechanism for temporarily securing a line in a desired position. As such, these devices include, without limitation, friction cleats, cam cleats, buckles or the like, such that the length of a line can be mechanically fixed at a desired amount and subsequently released.

As used herein, the term "chicken loop line" is meant to mean and include any line configured to transmit tractive force from the front lines to the user.

As used herein, the term "chicken loop" is meant to mean and include any attachment point for releasably securing the kite to a user, so that the tractive force generated by the kite is transmitted to the user during normal operation. In one embodiment, the chicken loop line is reinforced with tubing and formed into a loop to allow easy engagement with a harness hook. In another embodiment, the chicken loop line is terminated in a metal ring that is designed to cooperate with a releasable shackle secured to the user. Any other suitable attachment mechanisms are also included. This term is not meant to include a safety line or attachment designed to depower the kite when the control bar is released.

The present invention is a control device for an inflatable kite wherein the fixed trim adjustment is located below the bar, between the user and the control device. In one embodiment, the fixed trim adjustment comprises a cleat secured to the chicken loop line, wherein the chicken loop line passes through a slidable attachment on the control device, up to a pulley attached to the front lines above the bar, down through a slidable attachment on the control device and finally through the cleat. In another embodiment, the fixed trim adjustment comprises a cleat secured to the chicken loop, wherein the chicken loop line extends from the front lines through a slidable attachment on the control device and is then secured to the cleat. Accordingly, the user is able to adjust the fixed trim by simply pulling more or less line through the cleat and then securing the line at the desired position. The position of the cleat below the bar makes it readily accessible to the user regardless of the amount of sheeting range available to the control system.

As will be discussed in detail below, the control device of the invention also provides significant performance and safety benefits. Attaching a safety line to the free end of the chicken loop line after it passes through the cleat permits the user to unhook from the chicken loop and drop the bar to completely depower the kite, while still remaining attached via the safety line. Further, a stopper ball can be fixed at a desired position on the portion of the chicken loop line extending from the control device to the pulley. This allows the user to control the sheeting range, so that the kite will not depower beyond a desired amount when the bar abuts the stopper. As can be appreciated, this arrangement facilitates no handed and one handed riding and allow the user to experience a desired amount of power from the kite without being forced to constantly sheet in. However, the user can still unhook and drop the bar to activate the safety depower without making any adjustment to the stopper. These benefits and others can more clearly be appreciated in view of the presently preferred embodiments illustrated in the figures.

Turning now to FIG. 1, a bow kite 10 generally has a flattened arc shape and comprises an inflatable strut 12 that forms the leading edge of kite 10. A plurality of rib inflatable struts 14 (shown in phantom) are aligned transversely with leading edge strut 12. A canopy 16 is secured to the framework created by struts 12 and 14 to form an airfoil capable of generating aerodynamic lift. Right and left steering lines 18 and 20 are attached to the wingtips of kite 10. Kite 10 as shown comprises front lines 22, which are attached via a bridle 24 to the leading edge inflatable strut 12.

Figure 2:
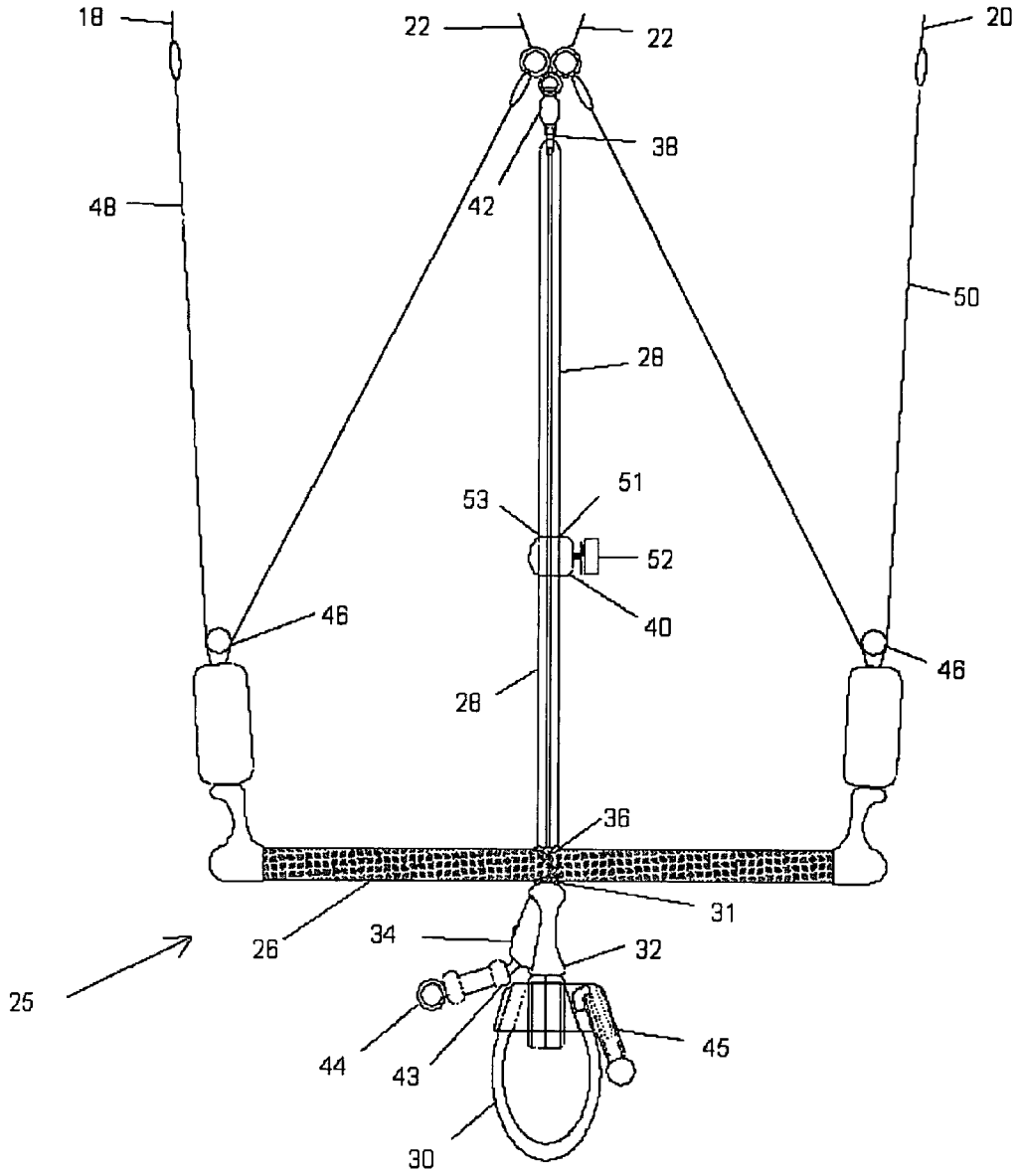
FIG. 2 is a perspective view showing a control device, according to the invention.
Figure 3:
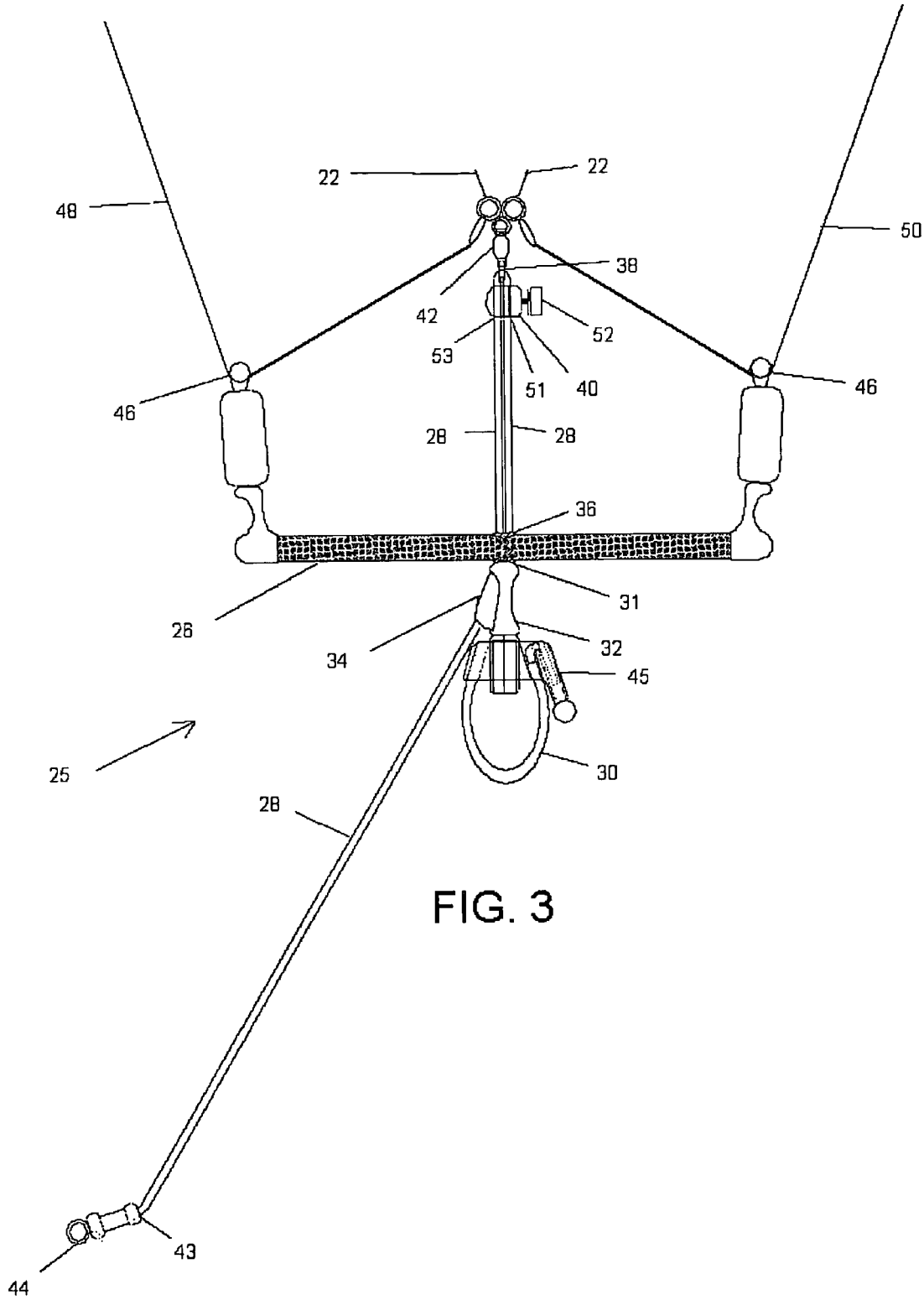
FIG. 3 is a perspective view showing the control device of FIG. 2, wherein the safety has been deployed according to the invention.

FIGS. 2 and 3 illustrate a system 25 including a control device in the form of bar 26, configured to transmit forces to and from steering lines 18 and 20 and front lines 22 to control kite 10. In particular, pivoting bar 26 tensions one steering line and slackens the other, causing kite 10 to turn. Chicken loop line 28 is secured to chicken loop 30 at end 31 by a swivel attachment 32. A releasable attachment such as cleat 34 provides the fixed trim adjustment and is attached to chicken loop line 28 below the bar and chicken loop line then passes through aperture 36 in control bar 26. Aperture 36 creates a slidable attachment for chicken loop line 28 to bar 26, and thus can be formed in the control bar 26 or can be in the form of an opening secured to the bar, for example in the form of a fairlead. Accordingly, sliding control bar 26 up and down chicken loop line 28 changes the length of steering lines 18 and 20 relative to front lines 22 and sheets kite 10 by changing the angle of attack, dynamically varying the trim.

In the noted embodiment, cleat 34 is attached to chicken loop line 28 via the swivel attachment 32 of chicken loop 30. In other embodiments, the releasable attachment can be secured directly to the chicken loop line.

Chicken loop line 28 extends from aperture 36 above the bar to pulley 38, which can be a traditional wheeled pulley, a ring, or any other suitable device that allows chicken loop line 28 to pass without unacceptable friction. A fixed stopper 40 that can be releasably secured to chicken loop line 28 may be positioned at any desired position between aperture 36 and pulley 38 to adjust the sheeting range. A swivel attachment 42 on pulley 38 forms a connection point for front lines 22. Chicken loop line 28 passes through pulley 38 and then down through aperture 36 (or a different suitable sliding attachment on bar 26) to cleat 34. Chicken loop line 28 preferably terminates at end 43 in a releasable attachment 44, such as a pin and sleeve release, a shackle, or other suitable device. By clipping a safety line (not shown) to releasable attachment 44, the safety depower capabilities of the control system are enabled. Chicken loop 30 also includes a quick release 45 that opens chicken loop 30 to release the user without having to unhook.

Further details regarding the use of an adjustable fixed trim on a control line positioned between the user and the control bar can be found parent application, U.S. patent application Ser. No. 11/100,911, filed Apr. 6, 2005, which is hereby incorporated by reference in its entirety.

In the noted embodiment, both ends of bar 26 are equipped with pulleys 46. Leaders 48 and 50 extend steering lines 18 and 20, and are routed through pulleys 46 and are secured to swivel attachment 42. This configuration provides a 2:1 purchase for steering lines 18 and 20. As can be appreciated, the pulley arrangement provides a greater length change of the steering lines 18 and 20 relative to front lines 22 for a given amount of bar movement as compared to a conventional, non-pulley control system.

The chicken loop line 28 configuration and cleat 34 can be used in a conventional manner to control the angle of attack of kite 10. Generally, a user employs the cleat 34 to adapt kite 10 to the prevailing wind conditions and moves the control bar 26 up and down chicken loop line 28 to provide immediate control over the kite's angle of attack, allowing the user to spontaneously generate more or less power in the kite as desired. Accordingly, the sheeting angles available by sliding control bar 26 up and down chicken loop line ranges from a minimum established when the bar is fully sheeted in to a maximum that depends upon the throw of the bar along the chicken loop line. Stopper 40 is used to adjust the amount of throw available, and thus, the range of dynamic trim control. Typically, a control bar is tuned so that maximum power is developed in kite 10 when a minimum of chicken loop line 28 is drawn through cleat 34, providing the greatest extension of front lines 22, and when control bar 26 is fully sheeted in to maximize the length of front lines 22 relative to steering lines 18 and 20. Likewise, kite 10 has the least amount of power when bar 26 is fully sheeted out and a maximum of chicken loop line 28 is drawn through cleat 34. Therefore, the range of sheeting angles available by sliding control bar 26 up and down chicken loop line 28 can effectively be translocated by drawing a portion of chicken loop line 28 through cleat 34 and securing it.

In use, control bar 26 provides a convenient and adaptable method of controlling a kite. Typically, a user can be secured to chicken loop 30 by a harness hook, shackle or other suitable means and have instantaneous control over the sheeting of the kite simply by moving control bar 26 up and down chicken loop line 28. The depower range discussed above can be established by drawing more or less chicken loop line 28 through cleat 34 and securing it.

Thus, the control systems of the invention employ a fixed trim adjustment that is located within easy reach of any user and assures that the trim of the kite can be set quickly and accurately. In addition to these benefits, it has been found locating the fixed trim adjustment below the bar minimizes the weight above the bar. This improved weight distribution contributes to an enhanced degree of control and feel. Locating the fixed trim components below the bar positions their weight closer to the center of gravity of the system, that is, the user. In turn, this reduces the swing weight of the control system, making it more responsive. The inventive designs also simplify the bar configuration considerably. Removing the components from the area above the bar reserves that space for the front lines and steering lines, reducing the chance of tangles or other unwanted interaction between the lines.

As discussed above, fixed stopper 40 can be secured to chicken loop line 28 at any point between aperture 36 and pulley 38. By positioning stopper 40 adjacent pulley 38, a maximum sheeting range is available, allowing the user to significantly depower the kite by pushing control bar 26 to stopper 40. Alternatively, stopper 40 can be positioned closer to chicken loop 30, decreasing the amount of depower available. This permits the user to generate power from the kite without having to apply pressure to the bar, allowing no handed riding, for example.

As shown in FIG. 2, fixed stopper 40 is adapted to receive a portion of chicken loop line 28 between chicken loop 30 and pulley 38 and to releasably secure to that portion. In the embodiment shown, stopper 40 has a lumen 51 that receives chicken loop line 28 and a screw-type fastener 52 that engages chicken loop line 28 within lumen 48. Alternatively, a friction clamp or other suitable mechanism can be used to releasably secure stopper 40 to chicken loop line 28. Stopper 40 is sized so that it cannot pass through aperture 36, thus limiting the throw of bar 26 on chicken loop line 28. Stopper 40 may further comprise an additional lumen 53, or other suitable guide, adapted to receive a portion of chicken loop line 28 that extends between pulley 38 and cleat 34. As discussed below, the portion of chicken loop line 28 extending between pulley 38 and cleat 34 travels freely through stopper 40 or, alternatively, does not engage stopper 40.

The safety features of bar 26 are enabled by securing end 43 of the chicken loop line 28 to the user. As with conventional safety systems, the user simply unhooks from chicken loop 30 and releases bar 26. FIG. 3 illustrates the configuration of bar 26 after release. Since end 43 is secured to the user through a safety line as described above, once bar 26 is released, chicken loop line 28 passes through pulley 38 and cleat 34, allowing the bar to travel up chicken loop line 28, at least until stopper 40 engages pulley 38. This amount of travel, in conjunction with the 2:1 travel of steering lines 18 and 20, thoroughly depowers the kite. The user can reset the system simply by pulling the control bar 26 back down chicken loop line 28 and hooking into chicken loop 30 again. To utilize this aspect of the safety system, cleat 34 is configured to restrict movement of chicken loop line 28 when tension is applied from the direction of pulley 38, but releases when tension is applied from the direction of end 43. As discussed above, a cam cleat or similar mechanism provides this functionality. One of skill in the art will appreciate that this system substantially minimizes the risks of tangles when activating and resetting the safety depower.

Preferably, chicken loop 30 is configured to allow ready engagement and disengagement with a harness hook worn by the user. Also preferably, chicken loop 30 is attached to chicken loop line 28 by a swivel attachment 32, such as a ball bearing race or other similar mechanism, and is conventionally formed by a tubing reinforced section of line, which will tend to hold the loop in an open position to allow ready engagement with a hook on the user's harness. Chicken loop 30 has a quick release safety 54 that allows the user to open loop 30, releasing from the user without unhooking. Alternative configurations of chicken loop 30 can also be employed, such as by terminating chicken loop line 28 with a rigid ring adapted to be retained by a shackle worn by the user, or other suitable methods.

As can be appreciated, routing chicken loop line 28 through bar 26 and providing chicken loop 30 with swivel attachment 32 minimizes the risk of tangling the control lines. For example, users of a kite may wish to perform spins, rotations or loops while flying the kite and may wish to loop the kite itself. All of these maneuvers will impart one or more twists in the control lines. Although such twists can be undone by performing the opposite maneuver, it is often more convenient to simply spin the control bar 26 in the appropriate direction, while maintaining the attachment of chicken loop line 28 to the user. In the present invention, the control bar 26 can be freely spun around chicken loop line 28. In turn, this allows the user to quickly untwist the control lines following a sequence of maneuvers without creating additional twists or tangles.

Figure 4:
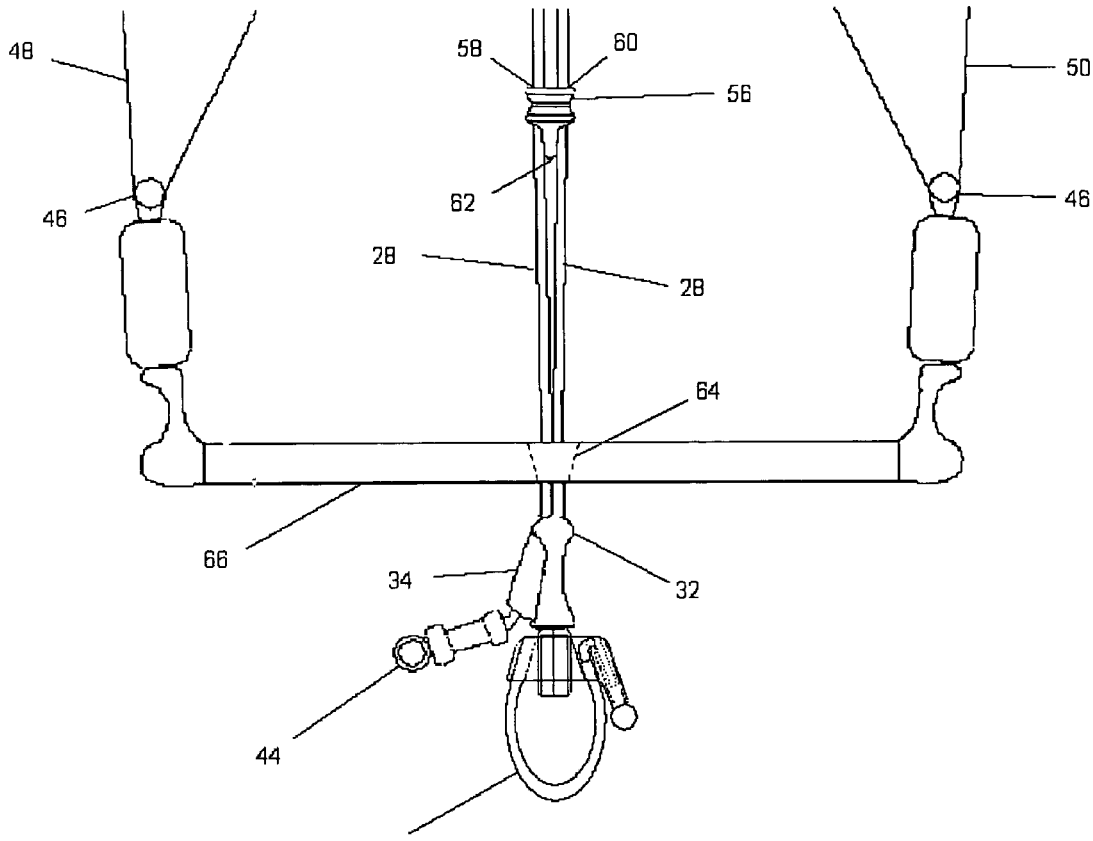
FIG. 4 is a perspective view of another embodiment, showing a quick adjust stopper ball; according to the invention.
Figure 5:
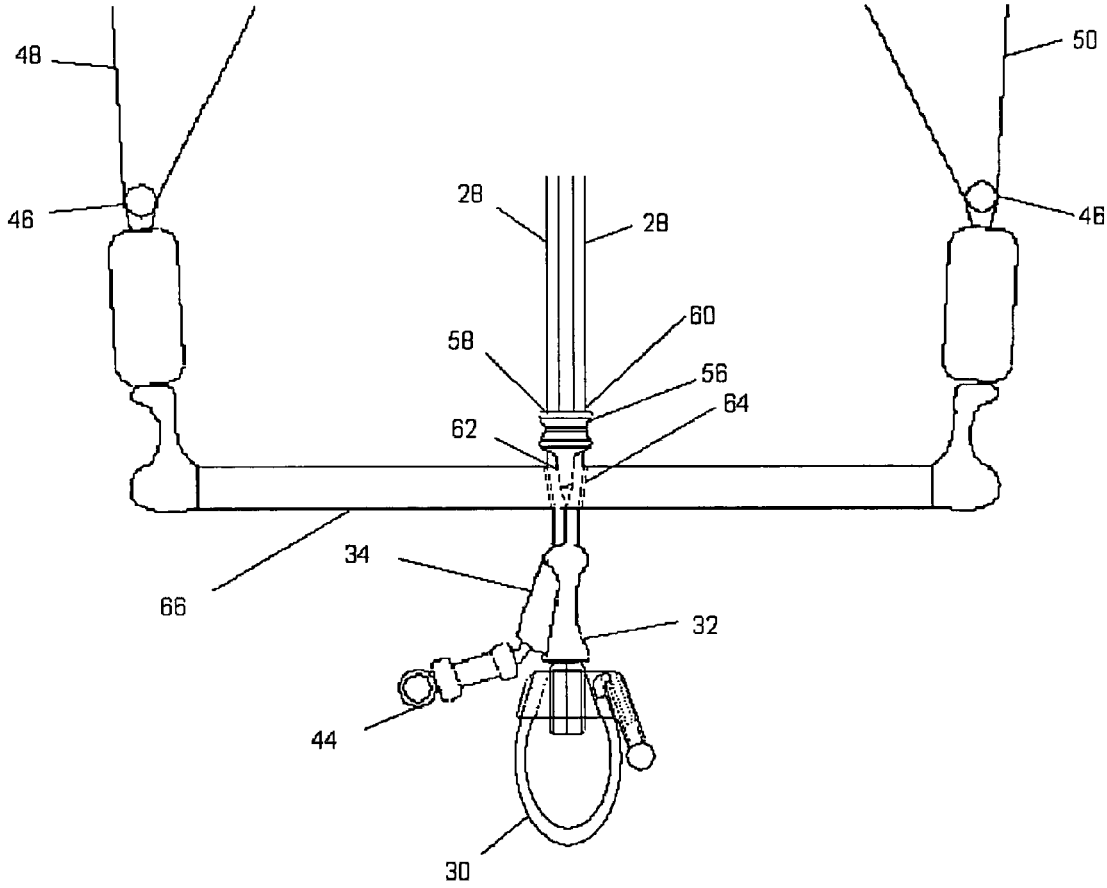
FIG. 5 is a perspective view of the control device of FIG. 4, showing the quick adjust stopper ball engaged; according to the invention.

In another embodiment of the invention, shown in FIGS. 4 and 5, a quick adjust stopper 56 comprises guides 58 and 60 adapted to receive both portions of chicken loop line 28 that extend from pulley 38. Guides 58 and 60 allow stopper 56 to be slid relatively freely along chicken loop lines 28, but provide sufficient friction to hold stopper 56 at the desired location when the user is not adjusting the position. Stopper 56 also comprises a wedge portion 62 configured to engage with tapered aperture 64 in control bar 66. Preferably, the surfaces of aperture 64 and wedge 62 have ridges or other features configured to increase friction with chicken loop line 28 when wedge 62 is engaged in aperture 64. Thus, when stopper 56 is not engaged as shown in FIG. 4, the user may simply slide stopper 56 to a desired position along chicken loop lines 28. As shown in FIG. 5, when control bar 66 is pushed against stopper 56, wedge 62 engages aperture 64, locking stopper 56 in position along chicken loop lines 28. While in this position, control bar 66 will rest against stopper 56 allowing the kite to remain sheeted at the desired angle without requiring the user to exert a pulling force. When the user does wish to sheet out, the user simply slides stopper 56 to a new position.

Further, the portion of chicken loop line 28 extending from pulley 38 to end 43 will still travel through aperture 64 towards the user, whether or not wedge 62 is engaged. Accordingly, the safety depower features described above work in the same manner. When restrained at end 43, chicken loop line 28 will travel through pulley 38 and aperture 64, lengthening the steering lines 18 and 20 with respect to front lines 22 and thoroughly depowering the kite.

Although quick adjust stopper 56 has been described with respect to one presently preferred embodiment, those having skill in the art will recognize that a number of suitable systems can be employed. In general, a quick adjust stopper embodying features of the invention cooperates with the bar so that when the bar is adjacent the stopper, friction between the chicken loop line, the bar and/or the stopper is increased, to restrict movement of the bar along the chicken loop line. For example, the two lumens in the quick adjust stopper can be set apart while the bar aperture is configured to bring them together. Furthermore, the use of the quick adjust stopper is independent of fixed trim system and can be employed using systems that do not utilize the chicken loop line to adjust the fixed trim.

Figure 6:
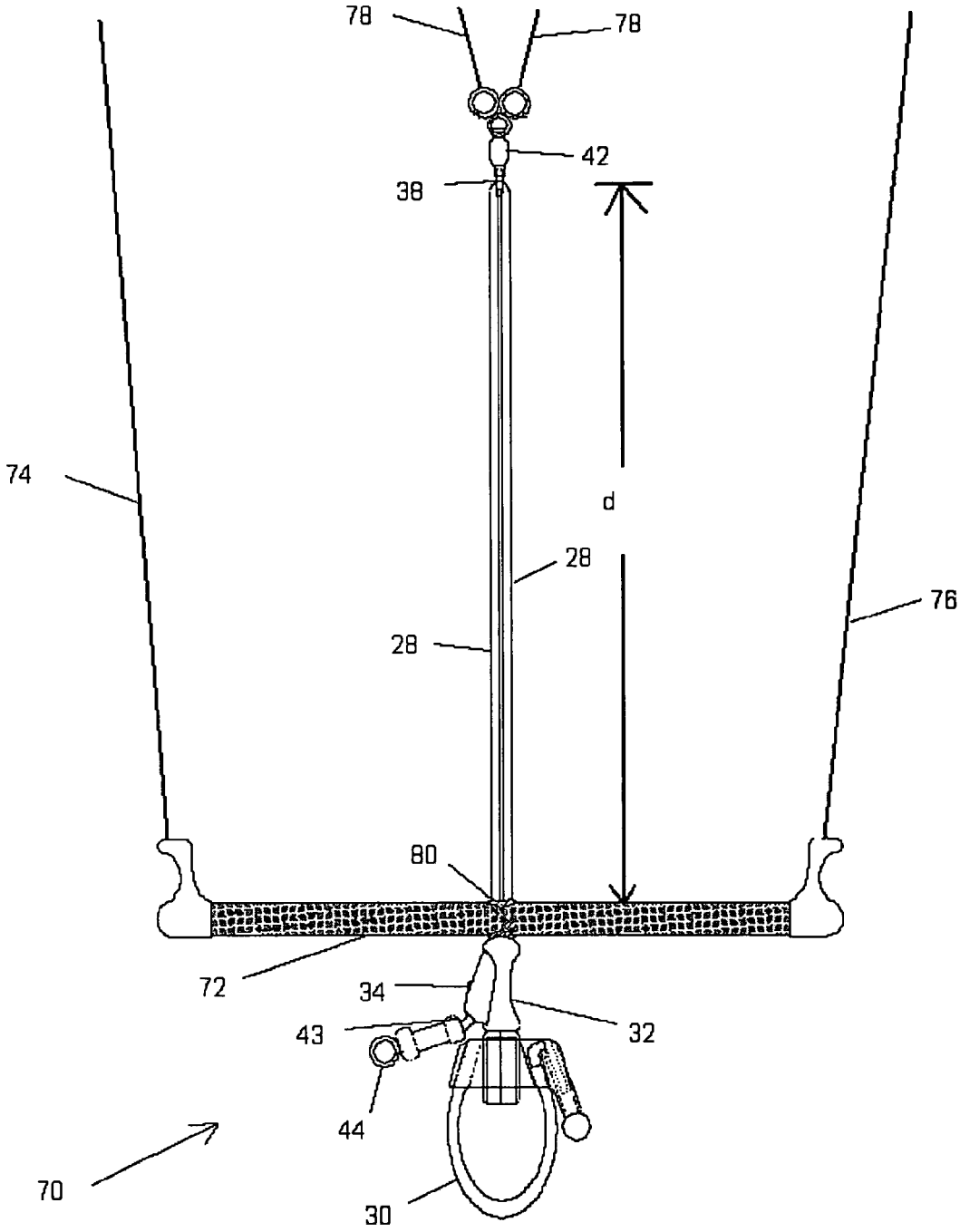
FIG. 6 is a perspective view of an alternative embodiment, showing a control device adapted for four line use, according to the invention.

Another embodiment of the invention is shown in FIG. 6. Control system 70 generally comprises a bar 72 for controlling steering lines 74 and 76 and front lines 78. In this embodiment, system 70 is configured to work with a conventional, four line kite or with a bow kite having a design that does not require the use of 2:1 pulley ratios at the steering lines. It can be desirable to avoid the use of a mechanical advantage for the control of the steering lines to improve feedback and provide a direct connection. As described above, chicken loop line 28 is secured to chicken loop 30 at end 31 by a swivel attachment 32. Cleat 34 is attached to chicken loop line 28 below the bar and chicken loop line then passes through aperture 80 in control bar 72. Chicken loop line 28 extends from aperture 80 above the bar to pulley 38, and swivel attachment 42 forms a connection point for front lines 78. Chicken loop line 28 passes through pulley 38 and then down through aperture 80 to cleat 34, where it can be releasably secured. Chicken loop line 28 preferably terminates at end 43 in a releasable attachment 44, for connection to a safety line.

As can be appreciated by one having skill in the art, the length of chicken loop line 28 "d" can be made as long as necessary to ensure that there is sufficient relative change in the length of front lines 78 with respect to steering lines 74 and 76 to adequately depower the kite when the safety is activated. This design freedom is enabled by locating all the user adjustable trim controls between the user and the bar and applies to all embodiments of the invention.

Figure 7:
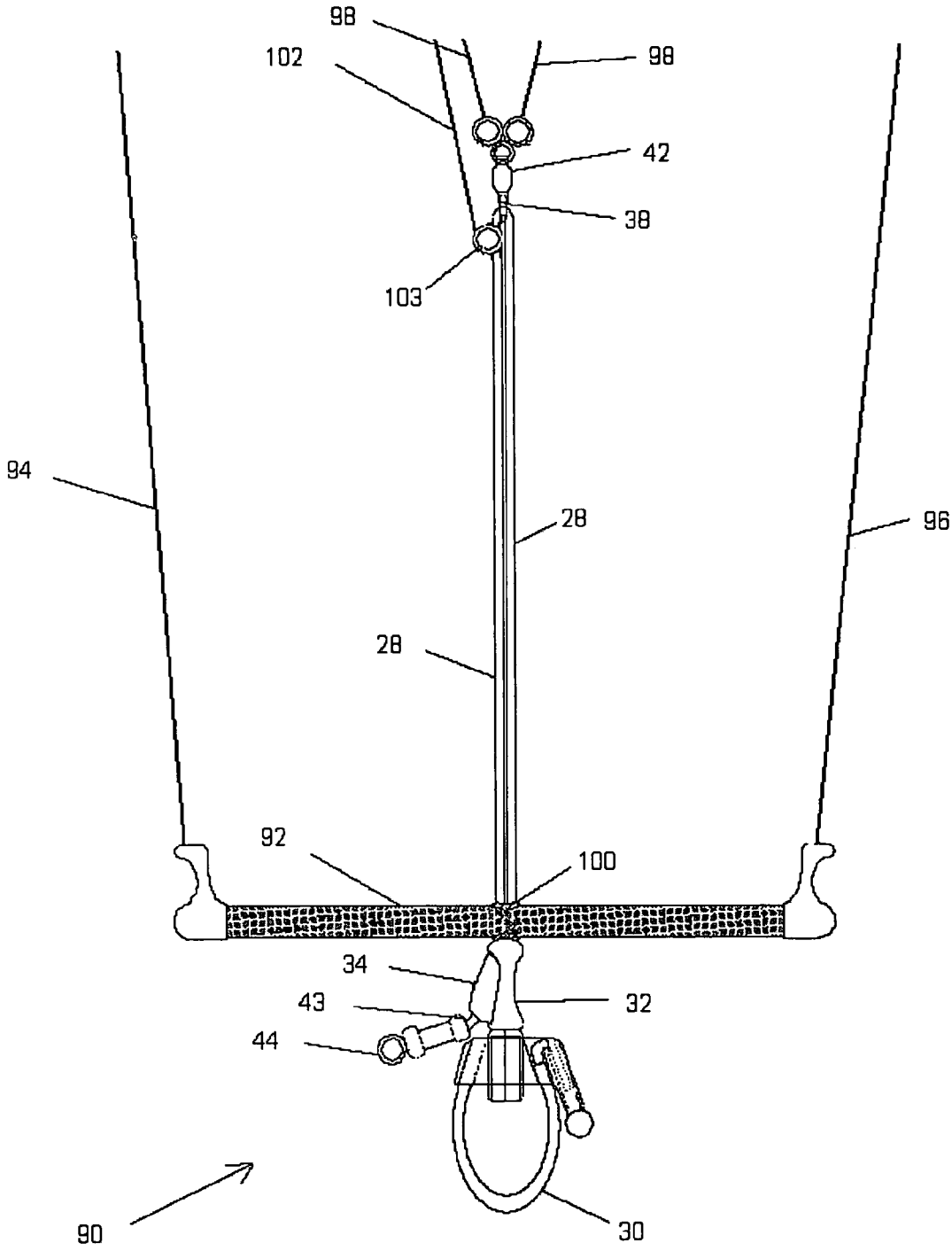
FIG. 7 is a perspective view of another embodiment, showing a control device adapted for five line use, according to the invention.

Another embodiment of the invention is shown in FIG. 7, which is configured to control a five line kite. As shown, system 90 generally comprises a bar 92 for controlling steering lines 94 and 96 and front lines 98. Chicken loop line 28, as described above, is secured to chicken loop 30 at end 31 by a swivel attachment 32. Cleat 34 is attached to chicken loop line 28 below the bar and chicken loop line then passes through aperture 100 in control bar 92. Chicken loop line 28 extends from aperture 100 above the bar to pulley 38, and swivel attachment 42 forms a connection point for front lines 78. Chicken loop line 28 passes through pulley 38 and then down through aperture 100 to cleat 34, where it can be releasably secured. Chicken loop line 28 preferably terminates at end 43 in a releasable attachment 44, for connection to a safety line. In this embodiment, a fifth control line 102 is secured to chicken loop line 28, between chicken loop 30 and pulley 38, at ring 103. Accordingly, sheeting chicken loop line 28 at cleat 34 adjusts both the fifth line tension and the relative length of front lines 98.

Figure 8:
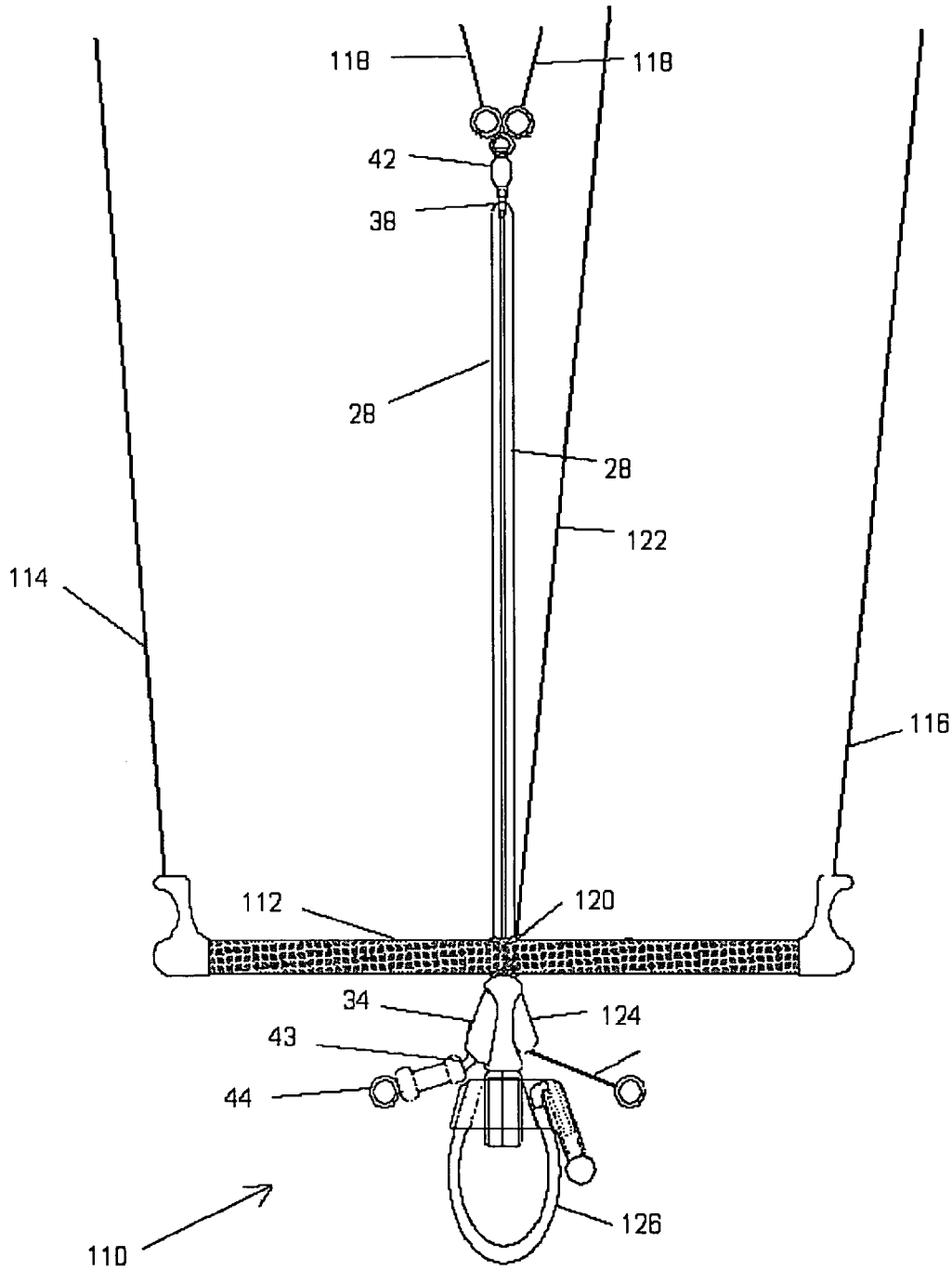
FIG. 8 is a perspective view of another embodiment, showing a control device that is also adapted for five line use, according to the invention.

Yet another embodiment is shown in FIG. 8 which is also configured to control a five line kite. As shown, system 110 generally comprises a bar 112 for controlling steering lines 114 and 116 and front lines 118. Cleat 34 is attached to chicken loop line 28 below the bar and chicken loop line 28 then passes through aperture 120 in control bar 92. Chicken loop line 28 extends from aperture 120 above the bar to pulley 38, and swivel attachment 42 forms a connection point for front lines 118. Chicken loop line 28 passes through pulley 38 and then down through aperture 120 to cleat 34, where it can be releasably secured. In this embodiment, a fifth control line 122 is releasably secured to cleat 124 on chicken loop 126. Further details regarding the operation of the fifth line in this embodiment are described in U.S. patent application Ser. No. 11/100,911, filed Apr. 6, 2005, which has already been incorporated by reference.

Figure 9:
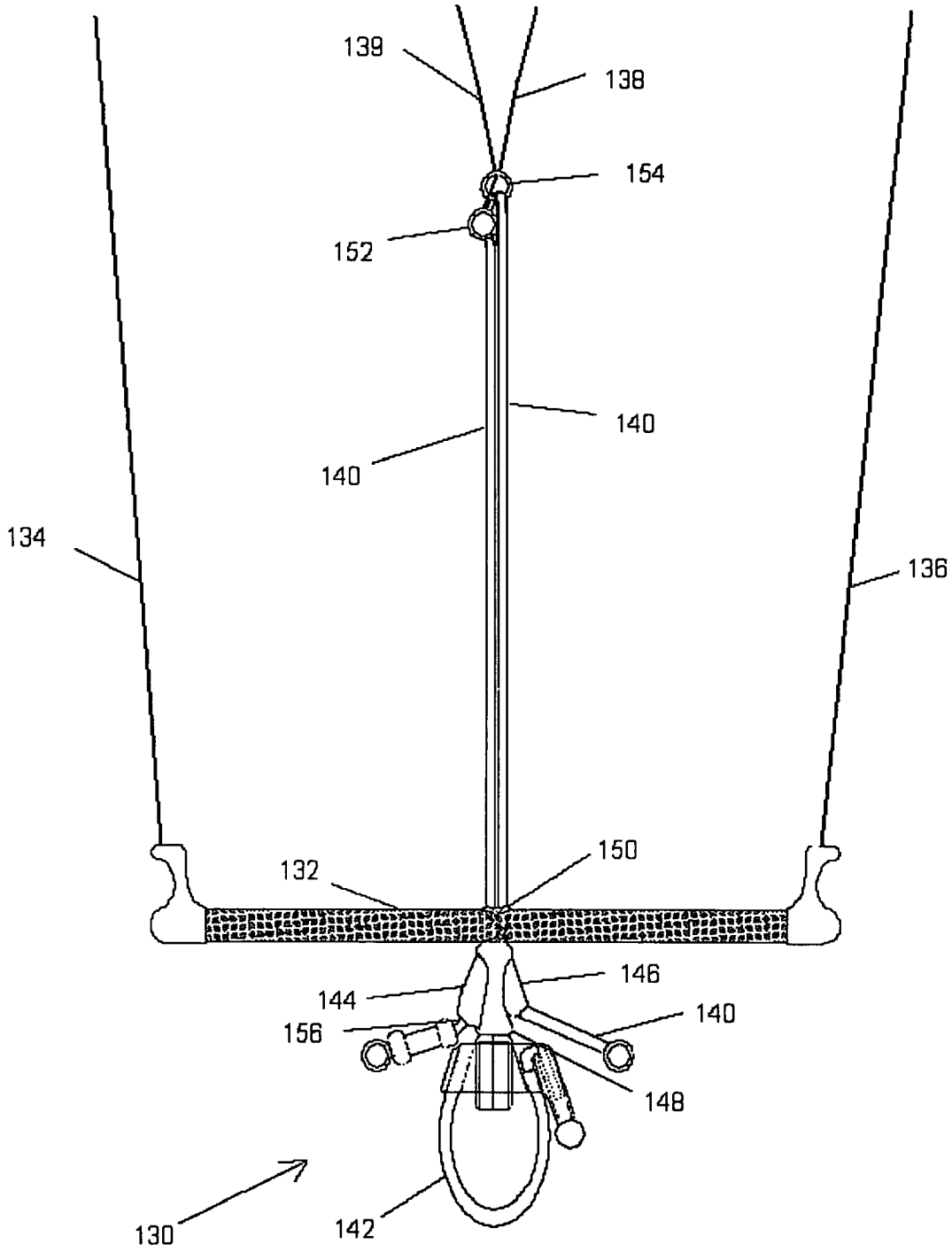
FIG. 9 is a perspective view of an alternative embodiment, showing a control device adapted for four line use and single line depower, according to the invention.

Another embodiment of the invention is shown in FIG. 9, which generally comprises system 130 configured to control a four line kite. As shown, system 130 generally comprises a bar 132 for controlling steering linesl34 and 136 and front linesl38 and 139. Both ends of chicken loop line 140 are secured to chicken loop 142 by cleats 144 and 146. Preferably, cleats 144 and 146 are secured to swivel attachment 148 portion of chicken loop 142, allowing the bar to be spun while the user is attached to chicken loop 142. Chicken loop line 140 extends from cleat 144 through aperture 150 in control bar to ring 152. Chicken loop line 140 continues from ring 152, through pulley 154 back through aperture 150 and is secured at cleat 146. Front line 138 is secured to ring 152 and front line 139 is secured to pulley 154. A safety line is typically attached to end 156 of chicken loop line 140.

The configuration shown in FIG. 9 allows control system 130 to activate a front line depower system. In operation, ring 152 cannot pass through pulley 154 and the kite flies normally. The user can adjust the trim of the kite by pulling equal amounts of chicken loop line 140 through each cleat 144 and 146 so that the front lines 138 and 139 remain balanced. To deploy the safety feature, the user unhooks from chicken loop 142, and releases bar 132. End 156 of chicken loop line 140 is restrained by a safety line, so the tension releases chicken loop line 140 from cleat 144 and pulls it through aperture 150. As can be seen, the attachment of front line 138 to chicken loop line 140 causes this line to remain tensioned, while remaining control lines 134, 136 and 139 are slackened by bar 132 traveling up chicken loop line 140. In turn, this differential shortening of one front line depowers the kite in a conventional manner.

Figure 10:
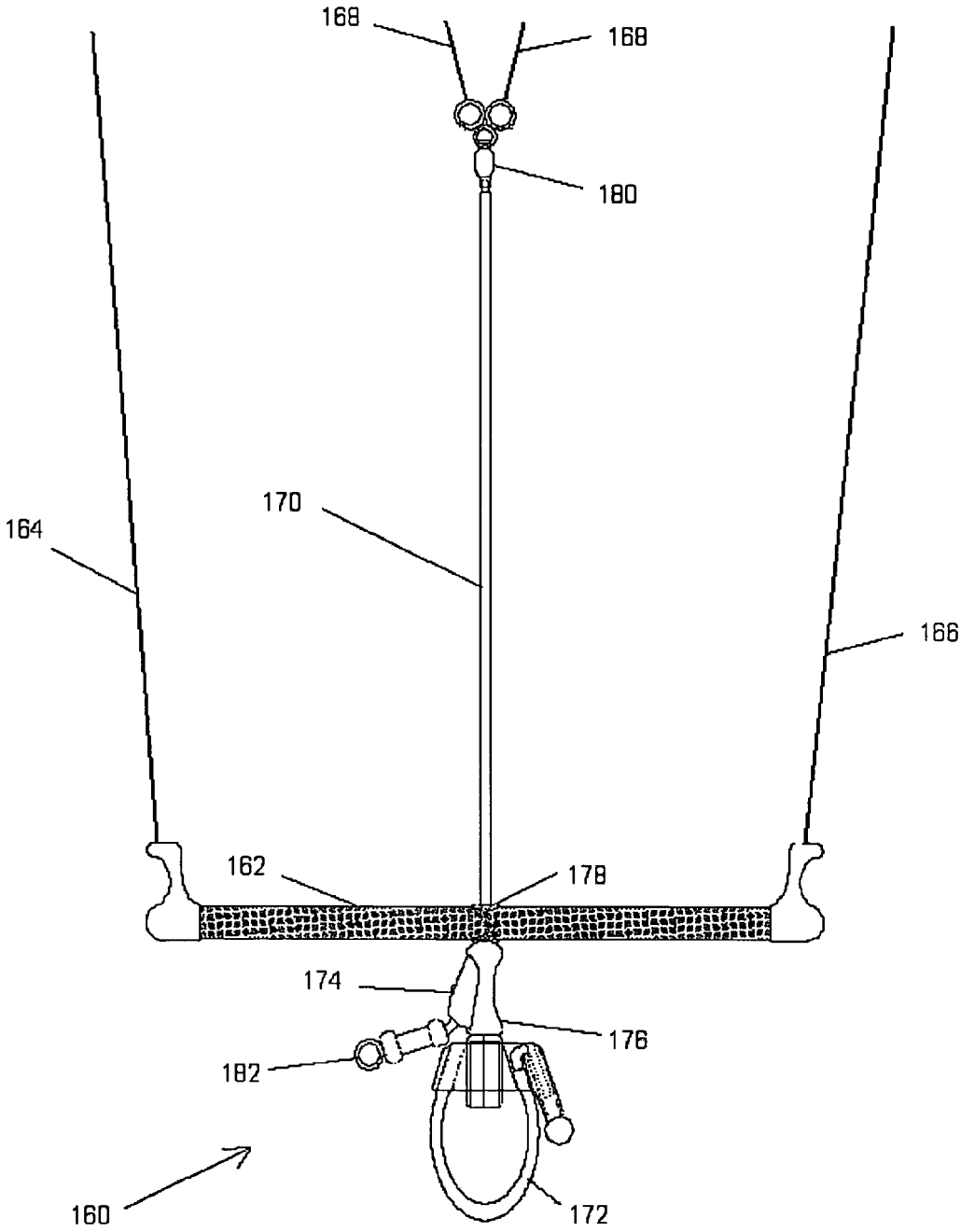
FIG. 10 is a perspective view of yet another embodiment, showing a control device adapted for four line use, according to the invention.

Still another embodiment of the invention is shown in FIG. 10. This embodiment is also configured to control a four line kite and generally comprises system 160 including a bar 162 for controlling steering lines 164 and 166 and front lines 168. Chicken loop line 170 is secured to chicken loop 172 by cleat 174, preferably to swivel attachment 176 portion of chicken loop 172, allowing the bar to be spun while the user is attached to chicken loop 172. Chicken loop line 170 extends from cleat 174 through aperture 178 in control bar to attachment 180, for connection to front lines 168. In use, the user trims the kite by drawing the desired amount of chicken loop line 170 through cleat 174 and releasably securing it. As described above, a safety line can be attached to end 182 of chicken loop line 170 to depower the kite when bar 162 is released.

Described herein are presently preferred embodiments, however, one skilled in the art that pertains to the present invention will understand that there are equivalent alternative embodiments. As such, changes and modifications are properly, equitably, and intended to be, within the full range of equivalence of the following claims.

What is claimed is:

1. A control device for use with an aerodynamic wing comprising a bar with opposing ends adapted to transmit steering forces to the wing and a chicken loop line adapted to transmit tractive forces to a user, wherein the line is routed through an aperture on the bar and secured at an adjustable attachment positioned between the bar and the user and not fixed to the bar, and wherein the adjustable attachment allows the user to vary the length of the chicken loop line independently of the relative orientation of the bar and the chicken loop line.

2. The control device of claim 1, wherein the chicken loop line is secured to a chicken loop, travels through the aperture on the bar, through a pulley above the bar, through the aperture on the bar before being secured by the adjustable attachment.

3. The control device of claim 2, wherein the aerodynamic wing is controlled by two steering lines and two front lines, wherein the steering lines are controlled by the opposing ends of the bar and wherein the front lines transmit force to the chicken loop line.

4. The control device of claim 3, wherein the relative length of the front lines with respect to the steering lines is adjustable by drawing a varying amount of chicken loop line through the releasable attachment and securing the chicken loop line in the adjustable attachment.

5. The control device of claim 3, wherein the control device further comprises a fifth line attached to the chicken loop line between the chicken loop and the pulley.

6. The control device of claim 3, wherein the control device further comprises a cleat secured to the chicken loop for adjusting a fifth line.

7. The control device of claim 3, wherein one of the front lines is secured to the chicken loop line between the bar and the pulley.

8. The control device of claim 2, wherein the adjustable attachment is secured to the chicken loop line below the bar.

9. The control device of claim 2, wherein the adjustable attachment is secured to the chicken loop.

10. The control device of claim 2, wherein the adjustable attachment is a cleat.

11. The control device of claim 2, further comprising a fixed stopper releasably secured to the chicken loop line between the bar and the pulley.

12. The control device of claim 2, further comprising a quick adjust stopper positioned between the bar and the pulley, wherein the quick adjust stopper includes two lumens adapted to receive the chicken loop line and wherein the quick adjust stopper is configured to cooperate with the bar to increase friction with the chicken loop line when the bar is adjacent the quick adjust stopper.

13. The control device of claim 12, wherein the quick adjust stopper further includes a wedge portion and wherein the aperture on the bar has a tapered opening, and wherein engaging the wedge portion of the quick adjust stopper in the aperture creates sufficient friction with the chicken loop line to restrict movement of the quick adjust stopper.

14. The control device of claim 2, wherein the chicken loop line has a distal end adjacent the adjustable attachment and wherein applying tension to the distal end releases the chicken loop line from the adjustable attachment, allowing the chicken loop line to travel through the pulley and through the aperture, decreasing distance between the bar and the pulley.

* * * * *